US006667580B2

(12) United States Patent
Kim et al.

(10) Patent No.: US 6,667,580 B2
(45) Date of Patent: Dec. 23, 2003

(54) CIRCUIT AND METHOD FOR DRIVING DISPLAY OF CURRENT DRIVEN TYPE

(75) Inventors: Hak Su Kim, Seoul (KR); Young Sun Na, Seoul (KR); Oh Kyong Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/187,991

(22) Filed: Jul. 3, 2002

(65) Prior Publication Data

US 2003/0006713 A1 Jan. 9, 2003

(30) Foreign Application Priority Data

Jul. 6, 2001 (KR) ..... 2001-40455
Apr. 26, 2002 (KR) ..... 2002-23059

(51) Int. Cl.[7] ..... G09G 3/10

(52) U.S. Cl. ..... 315/169.3; 315/169.2; 345/78; 345/76

(58) Field of Search ..... 315/169.2, 169.3, 315/169.4, 169.1; 345/77, 76, 78, 204, 208

(56) References Cited

U.S. PATENT DOCUMENTS 5,608,339 A * 3/1997 Fujiwara ..... 326/27
5,723,950 A * 3/1998 Wei et al. ..... 315/169.3
5,793,163 A * 8/1998 Okuda ..... 315/169.2
6,246,384 B1 * 6/2001 Sano ..... 315/169.3
6,323,631 B1 * 11/2001 Juang ..... 323/315
6,369,786 B1 * 4/2002 Suzuki ..... 345/77

* cited by examiner

*Primary Examiner*—James Charnley
*Assistant Examiner*—Ephrem Alemu
(74) *Attorney, Agent, or Firm*—Fleshner & Kim, LLP

(57) ABSTRACT

A circuit for driving a display of current driven type, and more particularly, to circuit and method for driving a display of current driven type, in which a pre-charging static power source is provided separately for implementing a low power consumption. The circuit for driving a display of current driven type comprises an organic EL, pixel, a scan driving part for making the pixel to emit a light in response to a scan signal, a first static current source for being controlled so as to be turned on/off in response to a data enable signal, to supply a current to the pixel, a second static current source for being controlled so as to be turned on/off in response to a precharge signal, to supply a current to the pixel for precharging the pixel, and a controlling part for controlling amounts of the currents from the static current sources.

9 Claims, 8 Drawing Sheets

CIRCUIT AND METHOD FOR DRIVING DISPLAY OF CURRENT DRIVEN TYPE

This application claims the benefit of the Korean Application Nos. P2001-40455 filed on Jul. 6, 2001, and P2002-23050 filed on Apr. 26, 2002, which are hereby incorporated by reference,

BACKGROUND OF THE INVENTION

1. Field of the Invention

The present invention relates to circuit for driving a display of current driven type, and snore particularly, to circuit and method for driving a display of current driven type, in which a pre-charging static power source is provided separately for implementing a low power consumption.

2. Background of the Related Art

Recently, passing ahead CRTs (Cathode Ray Tubes) that have been used the most widely, the flat displays, shown up starting particularly from the LCD (Liquid Crystal Display) at the fore front, are developed rapidly in the fields of PDP (Plasma Display Panel), VFD (Vacuum Fluorescent Display), FED (Field Emission Display), LED (Light Emitting Diode), EL (Electroluminescence), and the like.

Because the foregoing displays of a current driven type have, not only good vision and color feeling, but also a simple fabrication process, the displays are widening fields of their applications.

Recently, an organic EL display panel is paid attention as a flat display panel that occupies a small space following fabrication of large sized display.

The organic EL display is provided with datalines and scanlines crossed in a form of a matrix, in which a light emitting layer is formed in each of crossed pixels. That is, the organic EL display panel is a display a light emitting state is dependent on voltages provided to the datalines and the scanlines.

For tight emission from each of the pixels, one of the scanlines is made by a scan driving part to select a power source in an order starting from the first scanline to the last scanline during one frame period, and the datalines are selectively made by a data driving part to receive a power for the same frame period, for emitting a light from a pixel at which the scanline and the dataline are crossed.

Though current-light emission characteristics of the organic EL display panel is almost not dependent on a temperature, the current-light emission characteristics shifts toward a high voltage side as the temperature drops. Therefore, because it is difficult to obtain a stable operation, if the organic EL display is operated on a voltage, a static current driving type is employed in driving the organic EL display, FIG. 1 illustrates a related art circuit for driving an organic EL display panel.

Referring to FIG. 1, there is an anode of the organic EL pixel 103 having an Idd, a static current, supplied thereto through a static current source 101 and a switch for pixel 102. The static current source 101 controls the current to the anode of the organic EL pixel 103. A time the current is provided to the anode of the organic EL pixel from the static current source 101 is controlled by the pixel switch 102. That is, during the pixel switch 102 is turned on, the current flows from the static current source 101 to the anode of the organic EL pixel 103, and makes the organic EL pixel 103 to emit a light. In this instance, the turn on/off of the pixel switch 102 is controlled by means of a PWM (Pulse Width Modulation) waveform from the data driving part (not shown).

The PWM waveform for controlling turn on/off of the pixel switch 102 will be called as a data enable signal for convenience of explanation. A gray level of the organic EL pixel 103 is varied with a poise width of the data enable signal.

There is a scan driving part 104 of an NMOS driven by a scan signal, having a drain connected to a cathode of the organic EL pixel 103, and a source connected to another source voltage Vss, The organic EL pixel 103 emits no light instantly even if a current is provided thereto through the pixel switch 102. That is, the organic EL pixel 103 emits a light taking a responsive time period, because a voltage charging time period to a capacitor (not shown) inside of the organic EL pixel 103 is required.

Due to above reason, light emission of the organic EL pixel 103 at a desired gray level is difficult, has a poor luminance too, and requires much current owing to the voltage charge to the capacitor.

Thus, the display of current driven type consumes the more current at the display and the driving circuit, as a size of the display panel becomes the larger. Moreover, since the higher the resolution, the more the current requirement for obtaining a desired luminance, the more current is required for obtaining a desired luminance.

This large amount of current requirement serves as an unfavorable condition for portable devices, and brings about an unfavorable result to a lifetime of a display.

SUMMARY OF THE INVENTION

Accordingly, the present invention is directed to circuit and method for driving a display of current driven type that substantially obviates one or more of the problems due to limitations and disadvantages of the related art.

An object of the present invention is to provide circuit and method for driving a display of current driven type, in which a pre-charge system is employed for controlling a current amount.

Another object of the present invention is to provide circuit for driving a display of current driven type, in which a pre-charge timing is controlled for controlling a power for an entire system.

Further object of the present invention is to provide circuit and method for driving a display of current driven type, in which level and time of a pre-charge current are controlled for operation of a pre-charge within a range of a limited battery power so as to be suitable for application to portable devices.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the circuit for driving a display of current driven type includes an organic EL pixel, a scan driving part for making the pixel to emit a light in response to a scan signal, a first static current source for being controlled so as to be turned on/off in response to a data enable signal, to supply a current to the pixel, a second static current source for being controlled so as to be turned on/off in response to a precharge signal, to supply a current to the pixel for precharging the pixel, and a controlling part for controlling amounts of the currents from the static current sources.

The controlling part preferably controls a bias of the second static current source for controlling the amount of current from the second static current source.

In a case the organic EL pixel is burned on in rising synchronous, the second static current source is preferably turned on at a starting point of the scan signal, for starting precharge of the organic EL pixel.

In a case the organic EL pixel is turned on in falling synchronous, the second static current source is preferably turned on before the data enable signal is enabled, for starting precharge of the organic EL pixel.

Preferably, the precharge signal is a pulse width modulation signal, and a gray level of tile pixel is fixed according to a width of the precharge signal.

Preferably, the precharge signal is a pulse width modulation signal, and a precharge time of the pixel is fixed according to a width of the precharge signal.

Preferably, a plurality of static current sources designed in the driving circuit is turned on for use as the second static current source.

Preferably, the driving circuit further includes a first switch part for controlling turn on/off of the first static current source, the first switch part including a plurality of switch devices having drain terminals connected to the first static current source in common for being driven on reception of first to 'N' data enable signals respectively.

Preferably, the driving circuit further includes a second switch part to be driven upon reception of the precharge signal for controlling turn on/off of the second static current source.

The control part is provided between one ends of the first, and second switch parts and a ground voltage terminal for being driven *upon reception of bias signals in common.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 2:
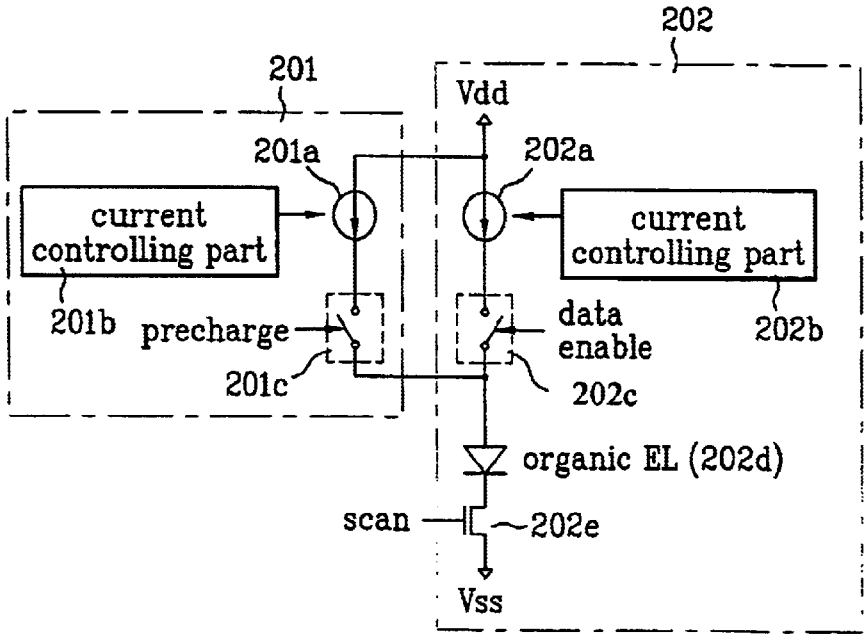
FIG. 2 illustrates a circuit for driving a display of current driven type in accordance with a preferred embodiment of the present invention.

Reference will now be made in detail to the preferred embodiments of the present invention, examples of which are illustrated in the accompanying drawings. FIG. 2 illustrates a circuit for driving a display of current driven type in accordance with a preferred embodiment of the present invention.

Figure 1:
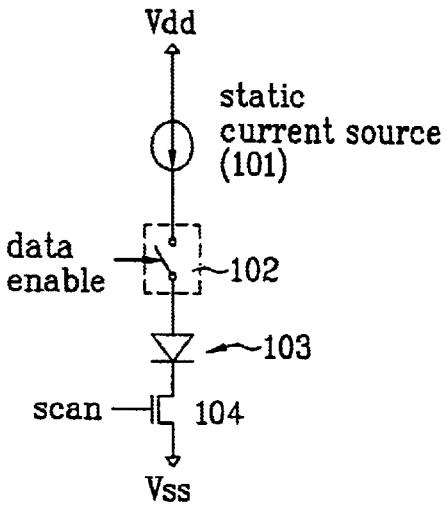
FIG. 1 Prior Art
FIG. 1 illustrates a related art circuit for driving a display of current driven type.

Referring to FIG. 2, the circuit for driving a display of current driven type includes a precharge part 210 in addition to the organic EL driving part 202 in FIG. 1. There are the precharge parts 201 and the organic EL driving parts 202 as many as a number of pixels arranged at crossing points of the datalines and the scanlines in the organic EL display panel.

The organic EL driving part 202 includes a static current source 202*a* for controlling a luminance of the organic EL pixel, a pixel switch 202*c* for being turned on/off in response to a data enable signal for applying a current from the static current source to the organic EL pixel, an organic EL pixel 202*d* for receiving the current through the pixel switch 202*c,* and emitting a light, and a scan driving part 202*e.* The static current source 202*a* has a current controlling part 202*b* for controlling an amount of the current from the static current source 202*a.* The data enable signal is a positive signal of PWM waveform with a predetermined width. A high period of the data enable signal is a duty cycle. The longer the high period of the data enable signal, the higher the gray scale.

The precharge part 201 includes a static current source 201*a* for controlling a precharge current, a current controlling part 201*b* for controlling an amount of the current from the static current source 201*a* to control a responsive time period of the organic EL pixel 202*d,* a precharge switch 201*c* for controlling turn on/off of the precharge to provide the current from the static current source 201*a* to the organic EL pixel 202*d.* A time period of the turn on/off may be controlled for controlling a precharging time period to the organic EL pixel 202*d.* That is, by controlling the precharging time period, a total power can be regulated.

One sides of the static current sources 201*a* and 202*a* of the precharge part 201 and the organic EL part 202 are connected to a power source Vdd in common, and one sides of the switches 201*c* and 202*c* of the precharge part 201 and the organic EL part 202 are connected to an anode of the organic EL pixel 202*d* in common.

The current controlling part 201*b,* or 202*b* can control a precharge current Ipd provided to the organic EL pixel 202*d* by controlling a bias of the static current source 201*a,* or 202*a* by using a resistor, or a digital/analog converter from an outside of the driving circuit.

A cathode of the organic EL pixel 202*b* is connected to a cathode circuit (not shown) connected to another power source Vss.

A precharge starting time is made to differ depending on a turn on time point of the organic EL pixel 202*d.* That is, when the organic EL pixel is driven by the rising synchronous type, the precharge starts at a starting point of a scan signal, and, when the organic EL pixel is driven by the falling synchronous type the precharge starts before a data enable starts.

FIGS. 3–6 illustrate examples the precharge starting time differs with the turn on time point of the organic EL pixel, for a case two of the circuit for driving a display for driving the organic EL pixel as shown in FIG. 2 for comparison. Each of FIGS. 3A, 4A, 5A, and 6A illustrates an example of a scan waveform from the scan driving part 202*c,* each of FIGS. 3B, 3C, 4B, 4C, 5B, 5C, 6B, and 6C illustrates an example of an organic EL pixel driven in response to a precharge signal and a data enable signal for data 1, and each of FIGS. 3D, 3E, 4D, 4E, 5D, 5E, 6D, and 6E illustrates an example of an organic El pixel driven in response to a precharge signal and a data enable signal for data 2.

That is, during each of high periods FIGS. 3B, 3D, 4B, 4D, 5B, 5D, 6B, and 6D, the switch 202*c* of the precharge part 201 is turned on to provide the current from the static current source 201 a to the organic EL pixel 202*d* for precharging. Also, during each of high periods of FIGS. 3C, 3E, 4C, 4E, 5C, 5E, 6C, and 6E, the pixel switch 202*c* of the precharge part 202 is turned on to provide the current from the static current source 202*a* to the organic EL pixel 202*d* for making the organic EL pixel to emit a light. The precharge signal for controlling turn on/off of the precharge switch 201*c* and the data enable signal for controlling turn on/off of the pixel switch 202*c* have a PMW waveform.

According to the high period, i.e., a pulse width, of the precharge signal, a responsive time of the organic EL pixel is fixed, and according to a high period, i.e., a pulse width, of the data enable signal, a gray level of the light emitting organic EL pixel is fixed.

FIGS. 3A–3E illustrate rising synchronous operative waveforms at various parts of the present invention, when a pre-charge level is the highest. The data enable signal for data 1 is a case when the pulse width is the largest (for an example, 256 gray scales) as shown in FIG. 3C, and the data enable signal for data 2 is a case when the pulse width is not the largest (for an example, 160 gray scales) as shown in FIG. 3E.

Referring to FIGS. 3A–3E, it can be noted in FIG. 3A that The precharge starts at a starting point of the scan waveform. That is, the precharge signal transits to high at the starting point of the scan waveform starting point, to turn on the precharge switch 201*c.* Then, the current from the static current source 201*a* is provided to the anode of the organic EL pixel through the switch 201*c* during the high period of the precharge signal, for precharging a capacitor inside of the organic EL pixel 202*d.* When the precharge signal is turned to low, to turn off the precharge switch 201*c,* no more current is provided to the organic EL pixel 202*d* from the precharge static current source 201*a.*

That is, all the precharges for data 1 and data 2 start at points the sam e with a starting point of the scan signal, when the organic EL pixel 202*d* is provided with a current as much as an amount of current set at the precharge static current source 201*a.* Once the precharge is finished according the foregoing process, the pixel switch 202*c* is turned on in response to the data enable signal, to provide a current as much as an amount set at the pixel static current source 202*a* to the organic EL pixel 202*d* through the pixel switch 202*c.* That is, once the precharge is finished, the data enable signal is turned to high, to turn on the pixel switch 202*c.* The high period of the data enable signal is fixed by a preset gray level. In this instance, since the organic EL pixel 202*d* is precharged by the precharging part 201 already, when the current is provided fiom the pixel static current source 202*a,* the organic EL pixel 202*d* emits a light, instantly. Therefore, the organic EL driving part 202 is not required to consume a current for charging a capacitor inside of the organic EL pixel 202*d.*

If the data enable signal is turned to low, the pixel switch 202*c* is also turned off, to provide the current from the pixel static current source 202*a* to the organic EL pixel 202*d,* no more.

FIGS. 4A–4E illustrate falling synchronous operative waveforms at various parts of the present invention, when a pre-charge level is the highest. The data enable signal for data 1 is a case when the pulse width is the largest (for an example, 256 gray scales) as shown in FIG. 4C, and the data enable signal for data 2 is a case when the pulse width is nor the largest (for an example, 160 gray scales) as shown in FIG. 4E.

Referring to FIGS. 4A–4E, it can be noted in FIG. 4A that the precharge starts at a starting point of the scan waveform. That is, the starting time point of the precharging differs with a size of the data enable signal, because sizes of the data enable signals for the data 1 and data 2 are different from each other, that also makes the precharges start at different time points.

If the precharge signal is turned to high to turn on the precharge switch 202*c,* a preset level of current is provided to the organic EL pixel 202*d* through the switch 202*c* from the precharge static current source 201*a* during a high period of the precharge signal. If the precharge signal is trained to low, to finish the precharging, the pixel switch 202*c* is turned on in response to the data enable signal, to provide a preset level of current from the pixel static current source 202*a* to the organic EL pixel 202*d* through the switch 202*c* during the high period of the data enable signal. In this instance, end time points of all data enable signals are the same with an end time points of the scan waveforms, regardless of sizes of the data enable signal.

FIGS. 5A–5E illustrate rising synchronous operative waveforms at various parts of the present invention, when a pre-charge level is at the middle different from FIGS. 3A–3E.

Figure 3:
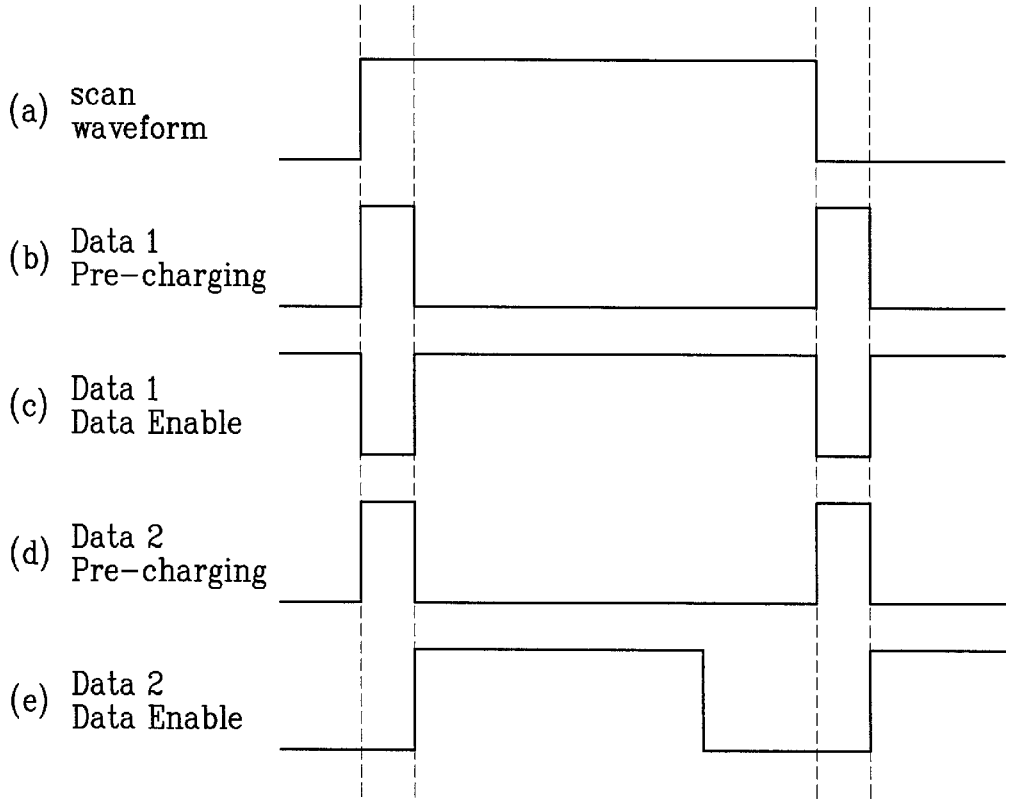
FIGS. 3A–3E illustrate rising synchronous operative waveforms at various palls of the present invention, when a pre-charge level is the highest.
Figure 5:
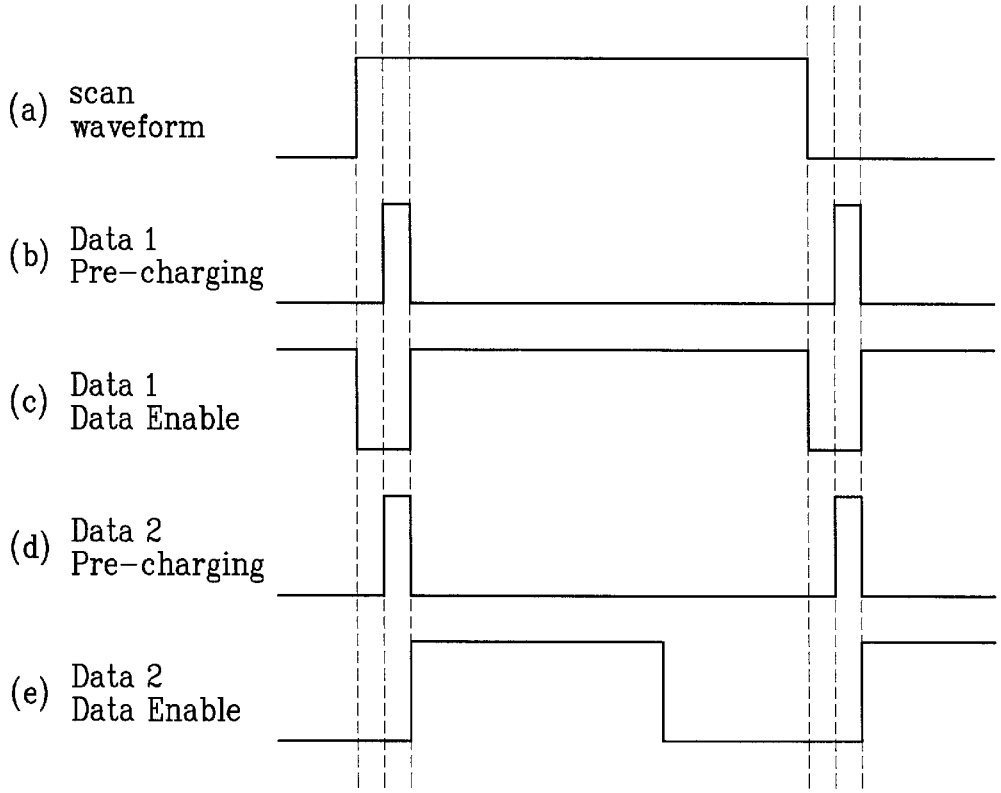
FIGS. 5A–5E illustrate rising synchronous operative waveforms at various parts of the present invention, when a pre-charge level is at the middle.
Figure 6:
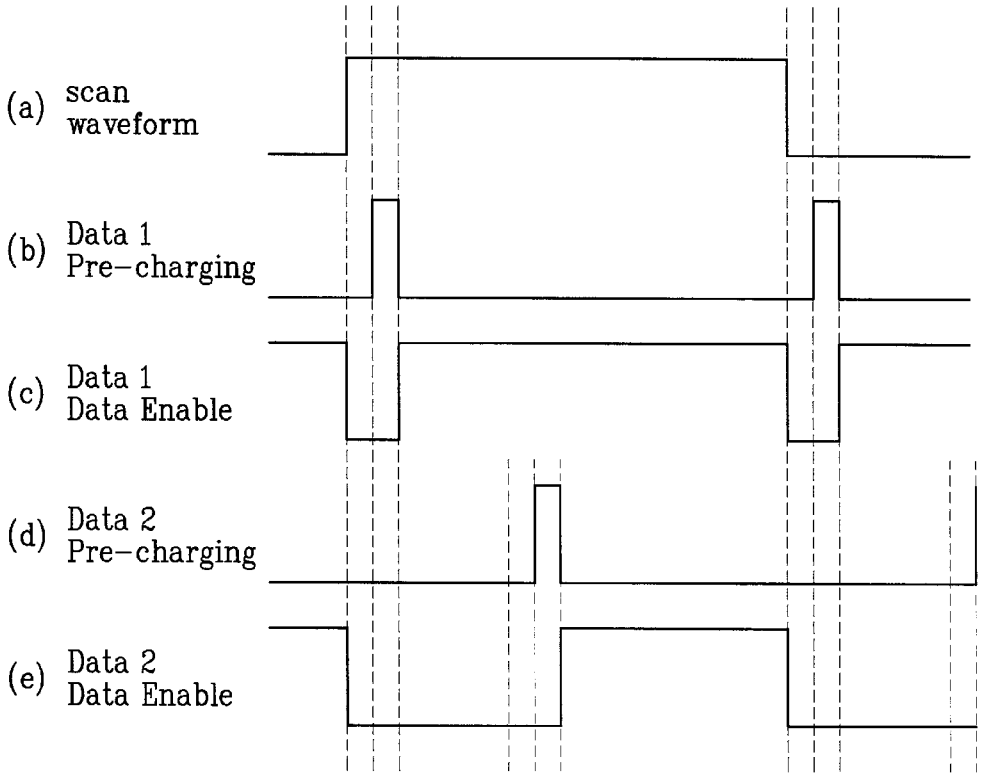
FIGS. 6A–6E, illustrate falling synchronous operative waveforms at various parts of the present invention, when a pre-charge level is at the middle.

Though the precharge time is the same with a starting part of a scan time period in FIG. 3, the starting time point of the precharge signal which turns on the precharge switch 201*c* falls, not on the starting part of the scan time period, but on the middle part of an entire precharge time period in FIG. 5. Referring to FIGS. 5B and 5D, it can be noted that all the time points the precharge signals for the data 1 and 2 are turned to high are at the middle of the entire precharge signals.

Depending on a size of the precharge signal which turns on the switch 201*c,* a turn on time point of the switch 201*c* falls on a particular part of the entire precharge time period. For an example, the longer the precharge time period, the turn on time point of the switch 201*c* falls on a front part of entire precharge time period, and the shorter the precharge time period, the turn on time point of the switch 201*c* falls on a rear part of the entire precharge time period.

Since operation hereafter is identical to the foregoing FIG. 3, detailed explanation will be omitted.

Figure 4:
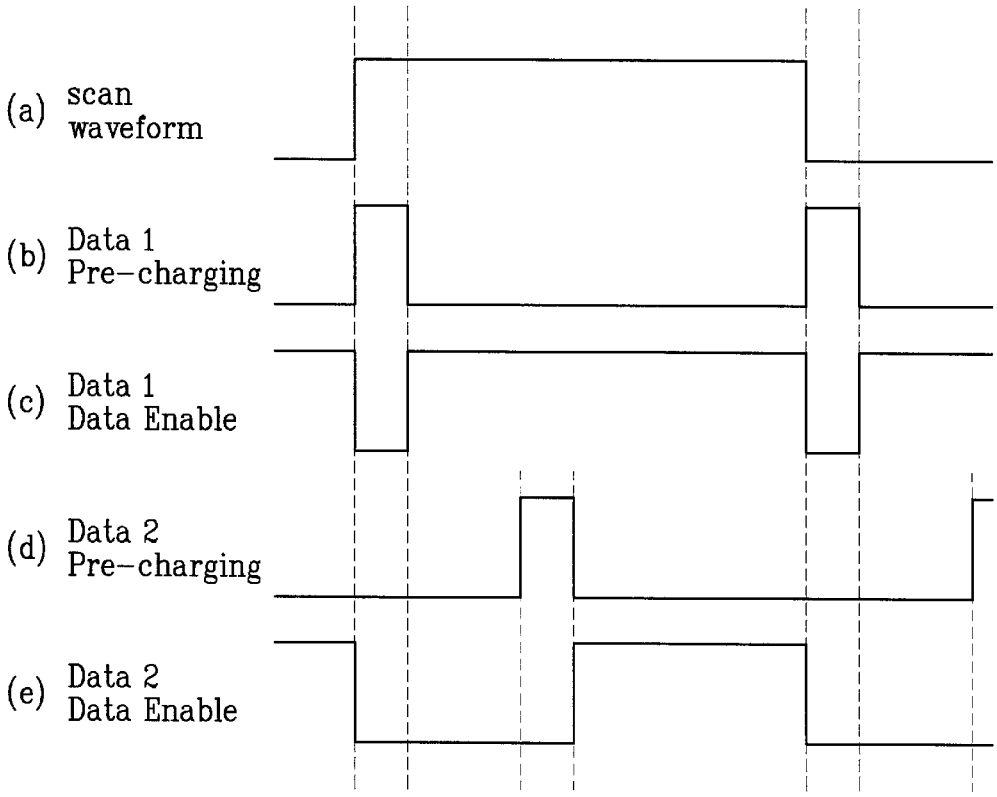
FIGS. 4A–4E illustrate falling synchronous operative waveforms at various parts of the present invention, when a pre-charge level is the highest.

Alike FIGS. 4A–4E, FIGS. 6A–6E illustrate falling synchronous operative waveforms at various parts of the present invention, when a pre-charge level is at the middle different from FIG. 4, Alikely, in FIGS. 6A–6E, all the data signals end at end time points of the scan times and the precharges are finished before the data enable signals are turned to high, i.e., before the switch 202*c* starts to turn on. In this instance, because the data enable signals for data 1 and data 2, which turn on the organic EL pixels have sizes different from each other, the precharges are also start at points different from each other.

The precharge signal which turns on the precharge switch 201*c* is turned to high starting from a part in a whole precharge time period, and is maintained at a high state for a preset precharge time period.

When the precharge signal is turned to high, to turn on the precharge switch 202*c,* a preset level of current is provided from the precharge static current source 201*a* to the organic EL pixel 202*d* for a high period of the precharge signal. If the precharge signal is turned to low, to end the precharging, the pixel switch 202*c* is turned on in response to the data enable signal, to provide a preset level of current from the pixel static current source 202*a* to the organic EL pixel 202*d* through the switch 202*c* for a high period of the data enable signal. In this instance, all time points the data enable signals end are the same with points the scan waveforms end regardless of sizes of the data enable signals.

In the meantime, the present invention may control entire power in precharging by providing a separate precharging static current source in the driving circuit, or by turning on, and using a plurality of static current sources already provided in the driving circuit on the same time.

Figure 7:
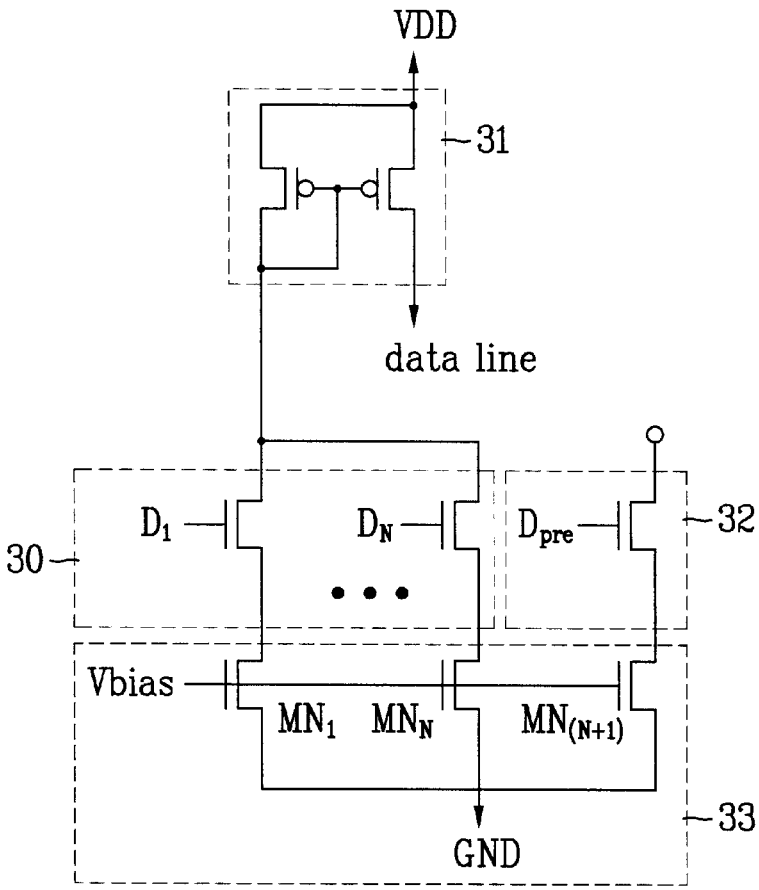
FIG. 7 illustrates one example of a precharge circuit of the present invention.
Figure 8:
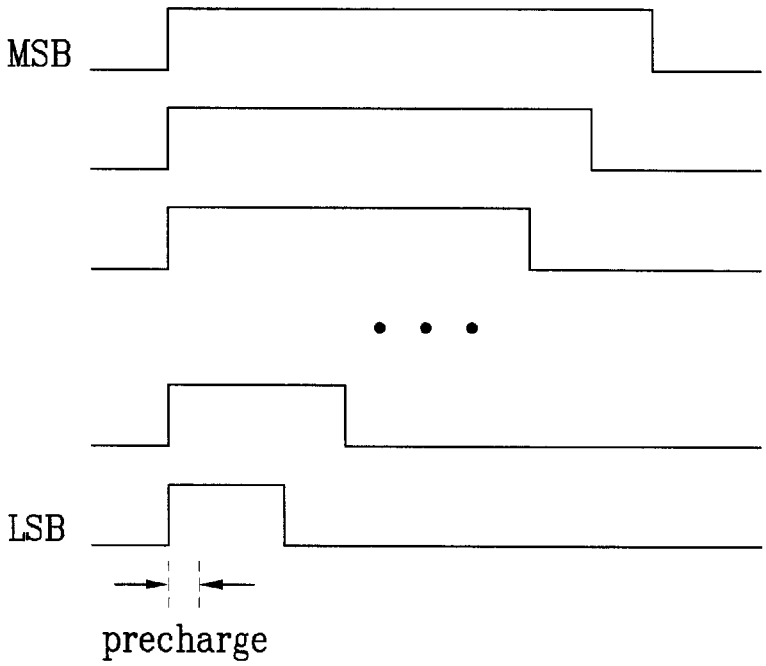
FIG. 8 illustrates rising synchronous waveforms of one example of a precharge circuit of the present invention.
Figure 9:
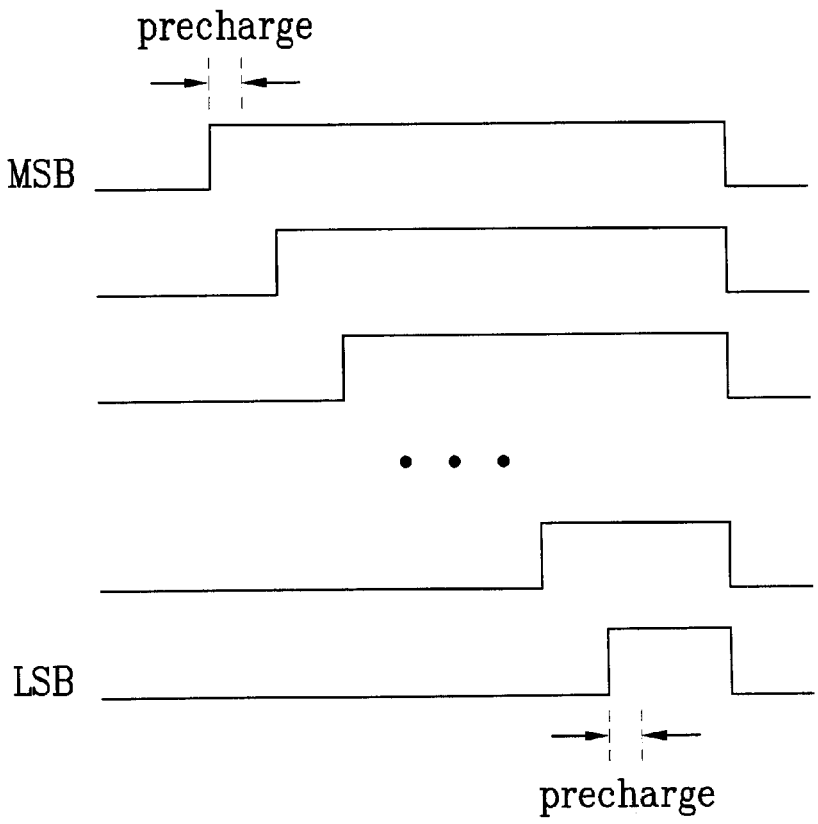
FIG. 9 illustrates falling synchronous waveforms of one example of a precharge circuit of the present invention.

FIG. 7 illustrates one example of a precharge circuit of the present invention, FIG. 8 illustrates rising synchronous waveforms of one example of a precharge circuit of the present invention, and FIG. 9 illustrates falling synchronous waveforms of one example of a precharge circuit of the present invention.

Referring to FIG. 7, the precharge circuit of the present invention includes a first current switch part 30 having a plurality of switch devices $D_1$–$D_N$ for controlling turning on/off of currents to datalines of respective organic EL pixels 202*d,* a second switch part 32 for controlling tuning on/off of currents required for precharge, a current controlling part 33 for controlling an amount of current according to desired luminance, and a current mirror part 31 having one end connected to one of switch devices in the first switch part 30 for transmitting a current to respective datalines.

The first switch part 30, the current mirror part 31, and the current controlling part 33 are the static current source collectively for expressing a gray level, and the second switch part 32 is the precharge static current source.

The plurality of switch devices in the first switch part 30 are turned on/off in response to respective control signals $D_1$–$D_N$, and formed of NMOS transistors which can control an amount of current each having a drain terminal connected to the current mirror 31 in common.

The second switch part 32, which controls turn on/off of a current required for precharge, is also formed of an NMOS transistor driven under the control of an external precharge control signal $D_{pre}$ if a rising synchronous type is employed. However, if a falling synchronous type is employed, it is required that the precharge control signals are produced from respective datalines individually, to require a delay block on each dataline.

The current controlling part 33, which controls an amount of current according to a desired luminance, includes a plurality of NMOS transistors each for being driven by a bias signal Vbias received in common.

Each of the plurality of NMOS transistors in the current controlling part 33 has a drain terminal is one to one connected to one of source terminals of the switch devices in the first switch part 30, or a source terminal of the NMOS transistor in the second switch part 32, and source terminals of the plurality of NMOS transistors in tie current controlling part 33 are grounded in common.

A method for driving a precharge of the present invention by using the foregoing precharge driving circuit is providing a static current of a preset current level to a dataline for a preset time period at an initial driving of a data electrode.

The current level of the precharge driving circuit is fixed within a range not exceeding a limit of a battery power under a condition all data electrodes are operative at a time, and the precharge time period is also fixed within a calculated fixed time period within a range not exceeding the battery power.

The method for driving a precharge of the present invention for controlling the precharge current level and the precharging starting time point within a range not exceeding the battery power limit may use the rising synchronous type or falling synchronous type as shown in FIGS. 8 and 9.

When the precharge is operated by the rising synchronous type, a precharge control signal Dpre is received from outside in common. In the rising synchronous type operation, pulses representing different gray levels are provided to the dataline, when precharge starting parts of the different waveforms shown in FIG. 8 are aligned.

Since currents required for the precharges are provided on the same time if the precharges are operated thus, an average amount of current required for all the precharges becomes the maximum.

When the precharge is operated by the falling synchronous type, the precharge control signal Dpre is produced at a relevant dataline individually, for which a delay part (not shown) is provided to each of the datalines. The delay part may be a RC delay, or a shift register.

The falling synchronous type operation waveforms are illustrated in FIG. 9, in which end parts of the signal waveforms are aligned, i.e., end parts of the precharges are aligned.

When the precharges are operated by the falling synchronous type, while current requirement for the precharges is irregular, and the delay part is required additionally, an average amount of current required for the precharges is smaller than operation by the rising synchronous type.

In the present invention, for implementing the precharge driving method by using the falling synchronous type, the precharge time is controlled by using the precharge control signal Dpre, and the bias signal Vbias is controlled for adjusting a precharge current level.

The precharge current level may be adjusted by controlling $D_1$–$D_N$, which will be explained, taking an example, When $D_1$ is set such that a current as much as 1 flows through an NMOS transistor which is operative under the control of $D_1$, $D_2$ is set such that a current as much as 2 flows through an NMOS transistor which is operative under the control of $D_2$, and $D_N$ is set such that a current as much as N flows through an NMOS transistor which is operative under the control of $D_N$, if only D1 is at a "high" level, while rest of the control signals are at "low", only a current as much as 1 is provided to the dataline through the current mirror 31, if both $D_1$ and $D_2$ are high, while rest of the control signals are at a "low" level, a current as much as 3 is provided to the dataline through the current mirror 31.

While the precharge current level is fixed according to the foregoing method, a precharge time is set by adjusting an external precharge control signal for operating the precharge within a range a sum of all currents does not exceed a highest power of the battery, i.e., a limit of the battery.

Thus, since the precharge current amount, and time are set so as not to exceed a maximum power of the battery, the circuit for driving a display of current driven type of the present invention is applicable to portable devices.

As has been explained, the circuit for driving a display of current driven type of the present invention permits, not only to reduce an amount of current provided to the organic EL pixel, but also to obtain a desired luminance by controlling a responsive time of a capacitor inside of the pixel, by providing a pixel static current source for supplying a current for driving the organic EL pixel, and a precharge static current source for precharging the pixel separately, for controlling operation of the organic EL pixel.

Moreover, since a precharge time and a current level can be adjusted so as not to exceed a maximum capacity of a battery by adjusting a precharge control signal Dpre and a bias signal Vbias, the circuit for driving a display of current driven type of the present invention permits an easy application to portable devices.

It will be apparent to those skilled in the art that various modifications and variations can be made in the circuit and method for driving a display of current driven type of the present invention without departing from the spirit or scope of the invention. This, it is intended that the present invention cover the modifications and variations of this invention provided they come within the scope of the appended claims and their equivalents.

What is claimed is:

1. A circuit for driving a display of current driven type comprising:

an organic EL pixel;

a scan driving part for making the pixel to emit a light in response to a scan signal;

a first static current source for being controlled so as to be turned on/off in response to a data enable signal, to supply a current to the pixel;

a second static current source for being controlled so as to be turned on/off in response to a precharge signal, to supply a current to the pixel for precharging the pixel, and a controlling part for controlling amounts of the currents from the static current sources.

2. A circuit as claimed in claim 1, wherein the controlling part controls a bias of the second static current source for controlling the amount of current from the second static current source.

3. A circuit as claimed in claim 1, wherein, in a case the organic EL pixel is turned on in rising synchronous, the second static current source is turned on at a starting point of the scan signal, for starting precharge of the organic EL pixel.

4. A circuit as claimed in claim 1, wherein, in a case the organic EL pixel is turned on in falling synchronous, the second static current source is turned on before the data enable signal is enabled, for starting precharge of the organic EL pixel.

5. A circuit as claimed in claim 1, wherein the precharge signal is a pulse width modulation signal, and a precharge time of the pixel is fixed according to a width of the precharge signal.

6. A circuit as claimed in claim 1, wherein the second static current source includes a plurality of static current sources.

7. A circuit as claimed in claim 1, further comprising a first switch part for controlling turn on/off of the first static current source, the first switch part including a plurality of switch devices having drain terminals connected to the first static current source in common for being driven on reception of first to 'N' data enable signals respectively.

8. A circuit as claimed in claim 1, further comprising a second switch part to be driven upon reception of the precharge signal for controlling turn on/off of the second static current source.

9. A circuit as claimed in claim 7, wherein the control part is provided between one ends of the first, and second switch parts and a ground voltage terminal for being driven upon reception of bias signals in common.

* * * * *